United States Patent [19]

Loch

[11] Patent Number: 4,666,567

[45] **Date of Patent: * May 19, 1987**

[54] AUTOMATED ALTERNATING POLARITY PULSE ELECTROLYTIC PROCESSING OF ELECTRICALLY CONDUCTIVE SUBSTANCES

[75] Inventor: David M. Loch, Seattle, Wash.

[73] Assignee: The Boeing Company, Seattle, Wash.

[ * ] Notice: The portion of the term of this patent subsequent to Oct. 23, 2001 has been disclaimed.

[21] Appl. No.: 663,711

[22] Filed: Oct. 22, 1984

Related U.S. Application Data

[63] Continuation-in-part of Ser. No. 289,104, Jul. 31, 1981, Pat. No. 4,478,689.

[51] Int. Cl.[4] ..... C25D 5/18

[52] U.S. Cl. ..... 204/14.1; 204/23; 204/29; 204/228; 204/DIG. 9

[58] Field of Search ..... 204/14.1, 23, 29, 228, 204/DIG. 9

[56] References Cited

U.S. PATENT DOCUMENTS

| | | | |
|---|---|---|---|
| 2,558,090 | 6/1951 | Jernstedt . | |
| 3,577,335 | 5/1971 | Blitchington | 204/228 |
| 3,669,855 | 6/1972 | Smith | 204/58 |
| 3,674,659 | 7/1972 | Livermore et al. | 204/56 R |
| 3,708,407 | 1/1973 | Newman et al. | 204/56 R |
| 3,723,257 | 3/1973 | Bhattacharyya | 204/15 |
| 3,738,927 | 6/1973 | Miller | 204/228 |
| 3,892,636 | 7/1975 | Kaneda et al. | 204/37.6 |
| 3,929,593 | 12/1975 | Sugiyama et al. | 204/37.6 |
| 3,975,254 | 8/1976 | Elco et al. | 204/228 |
| 4,009,091 | 2/1977 | Washington et al. | 204/228 |
| 4,011,152 | 3/1977 | Rodrigues-Martinez | 204/228 |
| 4,026,781 | 5/1977 | Newman et al. | 204/228 |
| 4,478,689 | 10/1984 | Loch | 204/14.1 |

FOREIGN PATENT DOCUMENTS 53-37543 4/1978 Japan .

OTHER PUBLICATIONS

F. A. Lowenheim, *Electroplating*, McGraw-Hill Book Co., New York, 1978, pp. 416–417.

William F. Hall et al, "Pulse Reverse Copper Plating for Printed Circuit Boards", Feb., 1983.

Dynatronix Inc., advertisement, "Dyna-Pulse Periodic Reverse Series", Feb., 1982.

Dynatronix Inc., advertisement, "DP20 Series Pulse Plating Power Supply", Jun., 1980.

*Primary Examiner*—John F. Niebling

*Assistant Examiner*—William T. Leader

*Attorney, Agent, or Firm*—Schwartz, Jeffery, Schwaab, Mack, Blumenthal & Evans

[57] ABSTRACT

A method and apparatus for electroplating the surface of a conductive substrate using an electroplating solution having a low concentration of plating ions. Forward and reverse polarity current pulses are alternatively provided between the part to be plated and an anode in an electroplating bath. The process voltage, $V_p$, between the part to be plated and the anode is sensed and the time ratio between the forward and reverse current pulses is varied to maintain the process voltage $V_p$ below a burn voltage $V_b$.

27 Claims, 12 Drawing Figures

Fig. 2A PRIOR ART
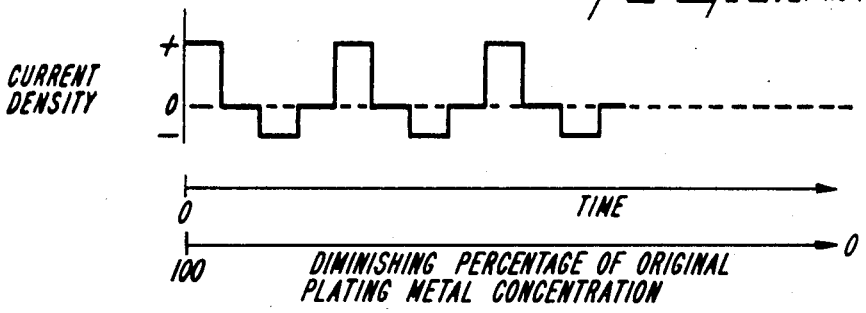
Fig. 2B
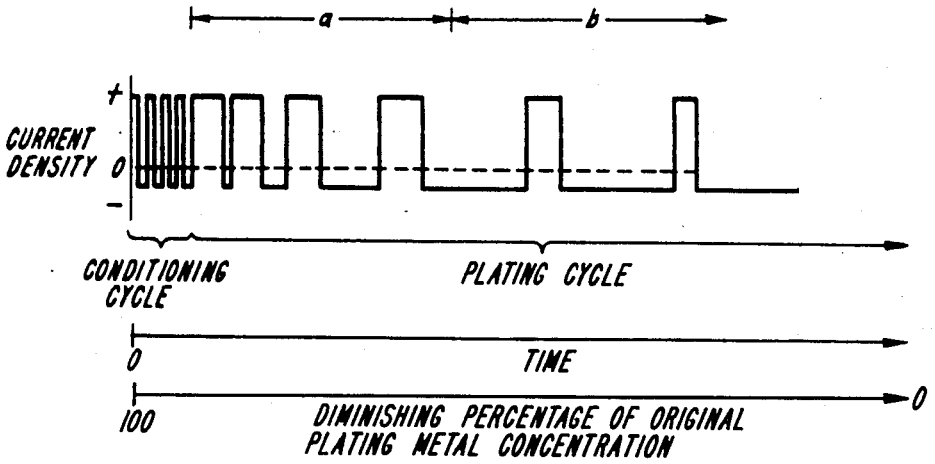
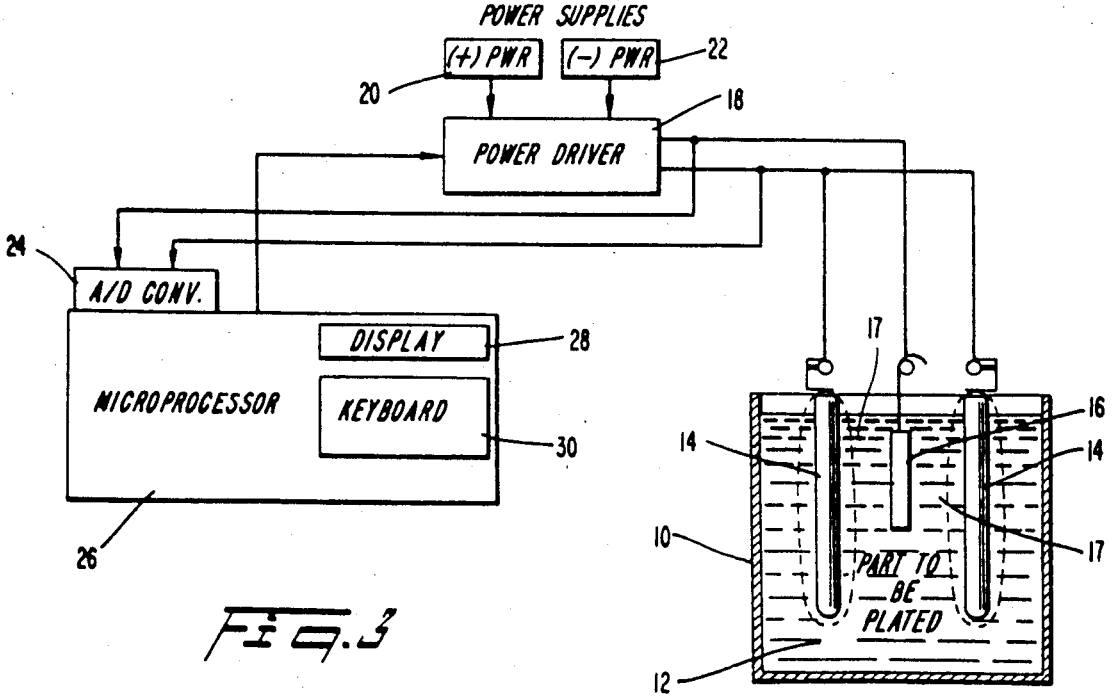
Fig. 3

POSITIVE POLARITY D.C. POWER SUPPLY
20
101
100
Vp
ANODE 14
PART 16
18
POWER DRIVER
O
NC
201
200
NEGATIVE POLARITY D.C. POWER SUPPLY
22
120 VOLT A.C. SOURCE FROM 120 VAC. SOURCE
F1
S1
NE1
62
60
34
MICROPROCESSOR POWER SUPPLY
-15 0 +5 +15 115 VAC
32
R10 430~
Q2
RELAY COIL K1
X
Y
D4
R9 7.5K~
R8 750~
R11 4.7K~
LED 1
LED 2
Q1
R7 100~
U2A
BUFFER/RELAY DRIVER
36
24
A/D CONVERTER
R1 100~(2W)
R2 2450~(25W)
D1
D2
R3 15~(1/4 W)
IN
AD570JD
8
DATA BUS
DATA READY
CONVERT
OUT
V1N-1 MICROPROCESSOR
26

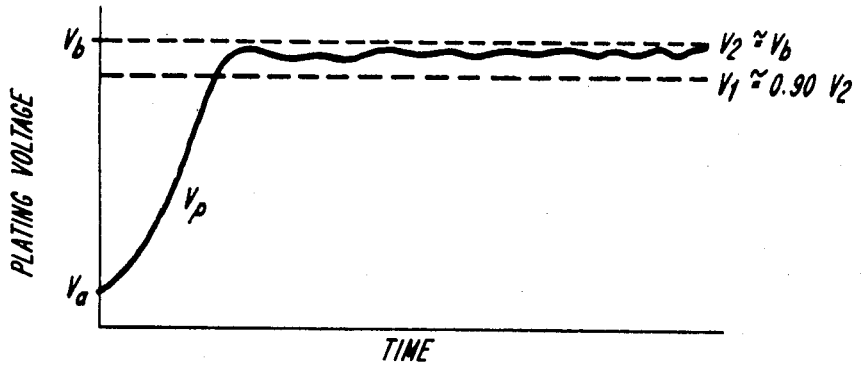
Fig. 9 SETTINGS FOR MAXIMUM PLATING RATE
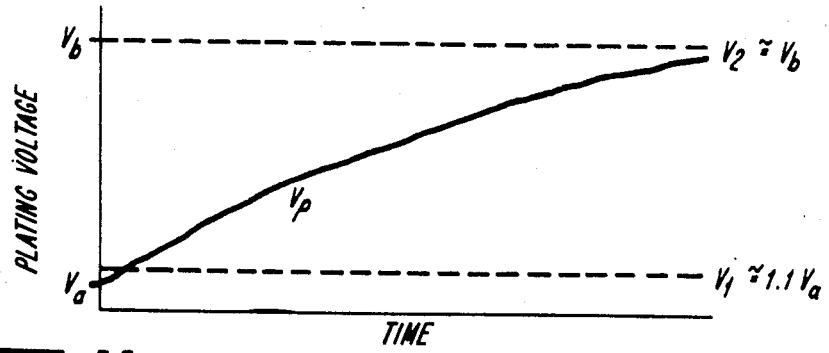
Fig. 10 SETTINGS FOR MAXIMUM COATING THICKNESS

AUTOMATED ALTERNATING POLARITY PULSE ELECTROLYTIC PROCESSING OF ELECTRICALLY CONDUCTIVE SUBSTANCES

BACKGROUND OF THE INVENTION

This is a continuation-in-part of Ser. No. 289,104 filed on July 31, 1981, now U.S. Pat. No. 4,478,689.

The present invention relates generally to electrolytic processing of metals and specifically to electroplating dilute solutions of precious metals or the like onto a substrate. The invention further relates to the automated production of uniform metallic deposits on electrically conductive substrates.

When two electrodes are immersed in an electroplating solution containing plating ions and are connected in series with an external EMF, one of the electrodes, known as the cathode, becomes negative with respect to the other electrode, known as the anode, and an electrical potential is created between the two electrodes. As the potential is gradually increased, current begins to flow between the electrodes and metal from the plating ions is deposited at the cathode at a rate generally proportional to the potential created between the two electrodes.

In general, as the potential between the electrodes gradually increases, the plating rate will increase. However, at a certain potential the plating ions are plated out almost as rapidly as they can diffuse towards the cathode. In other words, the concentration of plating ions in a boundary layer of solution around the cathode approaches zero. Under these circumstances, it is not the potential between the electrodes or the electric current produced by the potential that governs the plating reaction, it is the plating ion diffusion rate towards the cathode which governs the deposition of metal. It is advantageous to operate a plating process in a diffusion limited manner to provide a metal deposit thickness uniformity which approaches that of electroless or autocatalytic plating processes. For most electroplating solutions diffusion limited plating occurs in a small range of plating potentials at which the plating rate is constant. Current and voltage settings for a diffusion limited plating process can be empirically determined for a given electroplating solution composition and solution temperature. If the process potential is further increased beyond the diffusion limiting level, electrode reactions, such as increased hydrogen evolution, occur and the process current continues to rise. Plating ions are still deposited but the deposit produced is generally dull, rough, nodular and hence unacceptable. This condition is called "burning" of the deposit. As depicted in FIG. 1A, in order to produce an acceptable deposit, the process operator can empirically determine the region of diffusion control plating, determine the process potential at which burning occurs and then perform a plating process at a slightly reduced voltage from the burn voltage.

As previously indicated, operation of a plating process at an applied voltage which causes diffusion limited metal deposition is advantageous. However, such a process generally requires large current densities at the cathode which in turn requires a large power supply, heavy electrical busses, and large power leads to supply sufficient power.

Moreover, it is economically advantageous when electroplating precious metals such as gold, silver, rhodium, palladium, etc. to utilize very dilute solutions. This achieves minimum drag out losses and reduces precious metal inventory cost in the solutions. Drag out losses are the plating metal losses which occur as the part being plated is removed from the plating solution. It should be borne in mind, however, that very dilute solutions undergo a reduction in conductivity during plating as the metal ion concentration diminishes. Consequently, the electroplating voltage must increase to maintain a constant current density on the parts being plated. However, as alluded to above, the plating voltage must be maintained below the burn voltage at which the metal deposit becomes unacceptably dull, rough and nodular. Moreover, electroplating at or above the burn voltage results in excessive amounts of molecular hydrogen being infused into the part being plated rendering it imbrittled. In some cases, the part being plated may become etched. However, if the metal concentration in the solution is increased to remedy these effects, it causes the uniformity of the deposit thickness to decrease.

A summary of process-responsive trends in a dilute electroplating solution is tabulated in Table 1 below:

TABLE 1

| | Process Response Trends in Dilute Electroplating Solutions | | |
|---|---|---|---|
| | Deposit Thickness Uniformity | Plating Rate | Deposit Burning Tendency |
| Decreased solution temperature | ↑ | ↓ | ↑ |
| Decreased current density | No significant effect | ↓ | ↓ |
| Decreased metal ion concentration in solution | ↑ | ↓ | No significant effect |

In order to overcome the disadvantages of the prior art and to take advantage of the dilute plating solutions, the present invention provides a method and apparatus for operating in the diffusion limited deposition range without the costly requirement of high power levels. The present invention achieves this result by utilizing dilute electroplating solutions having relatively low plating ion concentrations. Dilute electroplating solutions require a lower current density at the cathode to establish a condition where the plating ions are plated out of solution almost as rapidly as they diffuse to the cathode; that is, the condition of diffusion limited deposition.

At first glance, it may seem that simply reducing or regulating the plating voltage would be sufficient for plating with a dilute plating solution. However, while a reduced plating voltage may solve any deposit burning tendency problem, plating voltage reduction has no significant effect on deposit thickness uniformity because voltage cannot regulate diffusion and mass transfer rates of plating ions other than to reduce them. Hence, there is a range of metal ion concentrations in the solution which minimizes solution costs, permits deposition of smooth, dense metal coatings, and results in maximum coating thickness uniformity on the part.

SUMMARY OF THE INVENTION

In view of the above prior art difficulties it is an object of the present invention to provide an automated process with improved voltage control in order to allow rapid electrolytic processing of electrically conductive substrates using dilute solutions of plating ions.

It is a further object of the present invention to provide a method of maintaining processing voltage below a burn voltage without substantially reducing the plating rate.

It is a still further object of the present invention to provide an apparatus for controllably reducing the time ratio of forward to nonforward power applied to a part being plated.

A further object of the present invention is to provide a method of process voltage feedback and process control by electronically monitoring process voltage and automatically adjusting positive and negative polarity current pulse durations during a process cycle.

It is a still further object of the present invention to provide a process voltage indicative of a plating ion concentration in a dilute electroplating solution being below a predetermined burn voltage, by flowing plating and diffusion current pulses between a part to be plated and an electrode.

It is a still further object of the invention to provide a process for electroplating using dilute electroplating solutions to optimize deposit thickness uniformity, maximize plating rate, and minimize deposit burning tendencies.

An important aspect of the present invention involves minimizing the plating ion concentration in the boundary layer of an electroplating solution about a part to be plated and optimizing the mass transfer and diffusion rates of the plating ions at the cathode.

In one preferred embodiment, a microprocessor or other device may be used to determine the duration of forward (plating) and reverse (diffusion) current pulses which are applied to the substrate or part to be plated. Current densities of the positive polarity pulses may range from about 10 to 300 amperes per square foot and the negative pulses range from 0.0 to about 100 amperes per square foot. The duration of the forward pulses, in a preferred embodiment, ranges from about 0.5 microseconds to about 300 seconds and the duration of the reverse pulses, when utilized, are preferably in the range of from about 0.5 microseconds to about 150 seconds. The durations of the forward and reverse pulses as well as their amplitude may be varied during operation in accordance with microprocessor instructions based upon a plating or process voltage. The method, and the apparatus to achieve the method, provides coatings produced from dilute electroprocessing solutions which have uniform thickness, bright appearance, smooth and fine grain, and which are relatively free from coating defects such as cracks, pits, or voids. The automated aspect of the process eliminates the extensive process knowledge and experience required for an operator to form uniformly thick, adherent, and smooth coatings on all substrate configurations.

BRIEF DESCRIPTION OF THE DRAWINGS

A more complete appreciation of the invention and the attendant advantages thereof will be more clearly understood by reference to the following drawings, wherein:

FIGS. 2A and 2B are graphs of current density versus plating metal concentrations in terms of percent of original concentration and time for the prior art processes and the present plating process, respectively;

FIG. 3 is an electrical block diagram of the present invention;

FIGS. 9–10 are graphs of process voltage versus plating time showing preferred control of settings and typical voltage profiles for specifically desired results.

DETAILED DESCRIPTION OF THE PREFERRED EMBODIMENTS

Figure 1A:
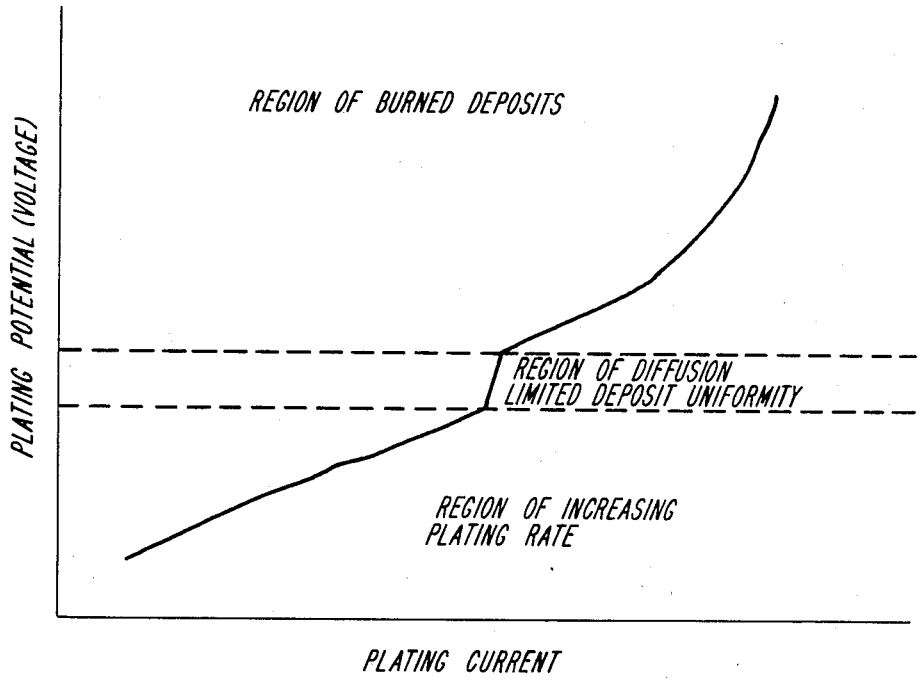
FIG. 1A is a graph of plating voltage versus plating current illustrating a region of diffusion limited metal ion deposit uniformity.

Reference will now be had to the drawings wherein like reference characters designate like parts throughout the various views. In understanding the present invention, a brief review of the problem and its causes may be helpful in understanding how applicant's invention overcomes these problems.

In the development of the present invention, it was realized that the coating burn voltage, ($V_b$), the process voltage excursion V(t), and the plating time (t) exhibit straightforward relationships between the parameters discussed in connection with Table 1. These relationships greatly simplify electroplating process knowledge.

As discussed above when electroplating with a dilute solution of plating ions, the electroplating solution undergoes a reduction in conductivity during plating as the plating ion concentration diminishes. As used herein "dilute solution" means electroplating solutions having a plating ion concentration on the order of 50 grams/liter or less in many precious metal solutions, yet it might be several ounces/liter or more in other metal solutions. The precise metal concentration range depends on the solubility of the metal salt, which defines the maximum concentration, and metal ion transport properties, which define the minimum concentration, for example, because of solubility limitations, rhodium metal concentration is typically limited to on the order of 1 gram/liter in the plating bath whereas chromium metal concentration typically is on the order of 40 ounces/gallon or more (300 grams/liter) to obtain sufficient solution conductivity. The concentration of the dilute solution may be empirically defined as that in which the plating current decreases during a plating cycle wherein the electrolyte temperature, plating voltage, and electrolyte agitation are maintained relatively constant. This refers to a plating cycle in which only the solution composition is allowed to change.

With dilute electroplating solutions, the electroplating process voltage must be increased to maintain a constant current density to the part being plated. If not controlled, this process voltage will eventually reach the burn voltage at which the metal deposit will become unacceptably dull, rough and nodular. Furthermore, for a given electroprocessing solution and temperature, the coating burn voltage $V_b$ is relatively constant. Therefore, if the process voltage excursion V(t) is maintained below the coating burn voltage $V_b$ in a dilute electroplating solution, then a maximum coating thickness can be uniformly obtained on any substrate and burned coatings can be avoided.

The process voltage excursion V(t) is characteristic of the mass transfer and diffusion rates of the deposited plating ions. For long plating times, which are necessary to obtain thick coatings, a high V(t) typically results in dilute solutions which produce coatings with less brightness, a slower plating rate, and more surface roughness than with coatings produced at a low V(t). The surface coating smoothness is crucial because it greatly affects the abrasion and corrosion resistance of the coating.

Therefore, to obtain the desired high thickness uniformity, high plating rates in dilute electroplating solutions, and a good deposit smoothness, control of the process voltage excursion V(t) is the key.

Ultimately, regardless of the electroplating solution composition or temperature, a long plating time (t) causes severe depletion of the plating ions which leads to very low plating rates. Therefore, the plating time (t) must be minimized with respect to controlling V(t). Therefore, to generate thick, adherent, and smooth coatings, the excessive process knowledge formerly required is reduced according to the present invention techniques to the following:

(i) Maintain V(t) below $V_b$ (ii) Maintain a low V(t)

(iii) Minimize t

As noted, it was previously appreciated that a voltage control power supply would provide the plating voltage controlled to practice the present invention techniques. However, voltage control does not regulate the mass transfer and diffusion rates of the plating ions except to reduce them. Hence burning of the deposit is unavoidable when using dilute electroplating solutions and relying only on a voltage control power supply. While no known prior art process can provide the proper voltage control to practice the plating techniques of the present invention, it is however noted that the above-mentioned application Ser. No. 289,104 filed July 31, 1981, does discuss various prior art anodizing processes and apparatus which utilize alternating polarity process currents.

Figure 1B:
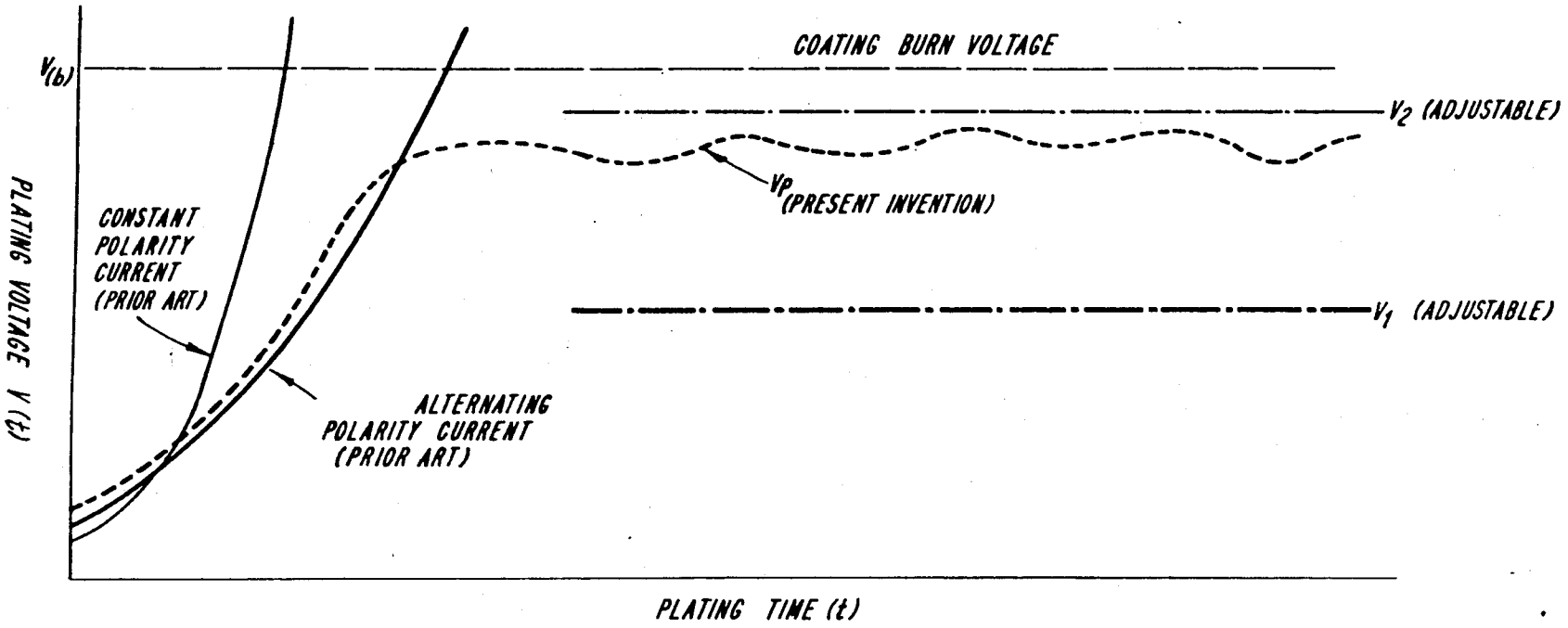
FIG. 1B is a graph of plating voltage versus plating time comparing prior art plating curves with a plating voltage process curve according to the present invention.

However, no known prior art techniques have reduced the extensive process knowledge for plating voltage control and no known prior art means can be used to carry out this control capability of a prior art anodizing process. The prior art voltage curves uncontrollably climb to the coating burn or breakdown voltage at which the anodizing coating burns or at which a metal plating would become dull, rough and nodular. Consequently only weak control of the plating time (t) is available while maintaining a high plating rate. FIG. 1B also shows in dashed lines a typical voltage control according to the present invention. Process voltage rate of increase can be controlled between $V_1$ and $V_2$ and, the peak voltage can be indefinitely limited to the $V_2$ while maintaining a high plating rate. Hence, V(t) and (t) can be fully controlled.

THEORY OF OPERATION

The present theory of process voltage control and coating property improvement is based on improved mass transfer and diffusion of the plating ions during processing. During plating processes utilizing low concentrations of plating ions, a covering of gas bubbles will tend to form on the cathode and the anode. As the plating time increases, the volume of gas about the electrodes tends to increase. When a dissolving anode is used as the source of plating ions, the concentration of plating ions also increases about the dissolving anode and begins to approach zero at the cathode. Eventually, using conventional plating techniques, the mass transfer and diffusion of plating ions nearly stops. Because power input to the process is unchanged, much of the power available is to drive nonplating reactions such as hydrogen generation at the cathode. This results in burned deposits at the reaction site. As a result, macrostructural deformation, voids, cracks and other subsurface coating defects are likely to occur.

On the coating surface, the high density covering of gas bubbles on the part and the anode also contribute to the further increase in process voltage. In the presence of an electroplating solution, resistive heating of the solution accelerates coating dissolution and dull appearance. Hence, the degree of degradation via resistive heating is proportional to the volume of gas about the electrodes.

The present invention utilizes direct current pulses of both forward and reverse (in a preferred embodiment) polarity in a specific manner in order to minimize the above described mass transfer and diffusion problems. Hereinafter, "reverse polarity" is used to define a diffusion pulse and includes time periods when no current is applied as well as reverse polarity periods which are preferred. During a forward polarity pulse a current flows to the part being plated and the resultant plating reactions generate a covering of gas bubbles on both the part and the anode. During the reverse polarity pulse, a current, having an amplitude smaller than the forward current, flows to the anode and as a result gas bubbles are discharged from both the cathode and anode and the high level of concentration of plating ions about the anode are repelled towards the cathode. Therefore, the release of gas bubbles and mass transfer of the plating ions are dependent upon the separation of the forward and reverse pulses.

During plating, the increase in process voltage V(t) is directly proportional to the degree of gas bubbles covering the electrode surfaces and the concentration of plating ions in the boudary layer of solution around the part being coated. Hence, any reduction in the degree of gas bubbles covering the electrode will result in a reduction of the process voltage. As noted above, the degree of gas bubbles covering the electrodes is a function of the forward pulses and an inverse function of the reverse pulses. The particular method and apparatus for choosing the magnitude and duration of forward and reverse pulses will now be discussed.

As the plating ion concentration decreases at the boundary layer, the duration of the reverse pulses must increase because the increased gas generated requires a longer degassing time and also because more repelling of plating ions away from the anode to the part is required. In other words, the mass transfer of plating ions to the part being plated must increase as the concentration of plating ions in the bulk of electroplating solution decreases. To achieve a practical plating process, however, the reverse pulse durations must be limited because no deposition occurs during this pulse. In fact, a zero current reverse pulse (in effect a pause in a forward pulse) will operate to produce an acceptable coating although not a preferred embodiment. Additionally, excessive reverse pulse durations would produce dissolution of the material plated on the part and a dull coating appearance. A simultaneous reduction in the forward pulse duration after a small increase in reverse pulse duration will permit a continuing decrease in the forward/reverse pulse duration ratio without having reverse pulses of an excessive length.

PROCESS DESCRIPTION

A comparison of a prior art anodizing current waveform with the waveform of the present invention is illustrated in FIGS. 2A and 2B. FIG. 2A shows a variable polarity waveform as disclosed in U.S. Pat. No. 3,983,014. While not directly analogous to the plating process of the present invention, the anodizing currents disclosed in U.S. Pat. No. 3,983,014 may assist in obtaining a better understanding of the present invention. According to the prior art, a forward pulse of a fixed duration is followed by a slightly shorter reverse pulse of a fixed duration in a periodic manner until either the desired coating thickness is reached or the coating breakdown voltage is reached. It should be understood that the duration of one complete cycle in the FIG. 2A waveform is typically one-tenth of one second or less as opposed to waveform durations of one microsecond or more in the FIG. 2B embodiment for the plating cycle. It should also be noted that FIG. 2B does not show zero current periods between positive and negative current pulses, although such finite periods actually exist. The zero current periods are omitted in the figure to denote a relatively short off-time between pulses compared to the pulse durations themselves.

The present invention is characterized by two separate cycles—the conditioning cycle and a plating cycle. The conditioning cycle, which may last 10 minutes, comprises short and constant duration pulses of both forward and reverse current polarity which "condition" the substrate in order to improve the deposit adhesion to it. The plating cycle shown in FIG. 2B is divided into two phases, phases a and b. Each of these phases includes a reduction in the time ratio of forward to reverse power applied. During phase a, a decreasing duration forward pulse is interrupted by an increasing duration negative pulse. In phase b, if further plating is necessary in order to build up an extremely thick coating or the solution is to be exhausted of plating ions, the pulse durations of forward and reverse pulses are maintained constant and the amplitude of the forward current pulses is decreased. In many instances, phase b is unnecessary because a sufficiently thick coating can be built up during phase a. However, it should be understood that phase b can advantageously be included with phase a when necessary. Furthermore, as long as the time ratio of forward to reverse power is decreasing as a function of plating ion depletion, the precise phase utilized is not of crucial importance. As should now be clear to the artisan, the magnitude of the reverse current flow could be increased while the forward current flow is constant or decreased in order to decrease the forward to reverse power ratio. Furthermore, combinations of phases a or b can be altered to provide a greater or quicker decrease in the forward to reverse power ratio.

In the embodiment of FIG. 2B, at the beginning of phase a, a maximum forward pulse may be applied for about 30 milliseconds followed by a reverse pulse applied for about 0.5 milliseconds. As the concentration of plating metal ions decreases, the process voltage increases to maintain a constant current input. In order to control the process voltage, the forward and reverse pulse duration ratios change in accordance with, for example, microprocessor instructions or the like, which are dependent upon the instantaneous process voltage V(t) necessary to maintain the appropriate current level. Toward the end of the plating cycle, when the coating has attained its maximum thickness, the final current waveform is such that the forward pulse duration is at a minimum value and the reverse pulse duration is at a maximum value. For example at the end of phase a, the forward pulse duration may be on the order of 5 milliseconds seconds and the reverse pulse duration on the order of 20 milliseconds. The maximum forward pulse duration and maximum reverse pulse duration illustrated are not drawn to scale and reflect only relative changes in pulse durations of forward and reverse pulses.

As noted earlier, in many instances, the maximum coating thickness is not desired, and in the preferred embodiment, the complete waveform alteration pattern shown in FIG. 2B is not required nor is maximum depositing ion concentration depletion required, and in the preferred embodiment, the complete waveform alteration pattern shown in FIG. 2B is not required in order to control the process voltage. The process voltage to the microprocessor control is illustrated in FIG. 1B where $V_p$ is the process voltage applied between the part and the anode at any point in time. It should be understood that the excursion or variation of $V_p$ shown in FIG. 1B is purely illustrative and intended only to depict the general automated voltage trend of a preferred embodiment. Voltage limits $V_1$ and $V_2$ are independently adjustable to control the process voltage excursions, thereby controlling the coating thickness and properties as well as the degree of plating ion concentration in the electroplating solution. $V_1$ is defined as the process voltage at which the microprocessor begins to alter the initially applied waveform by decreasing the forward to reverse power ratio. $V_2$ is the process voltage at which the microprocessor would generate a final waveform configuration which would have a forward pulse minimum duration and a reverse pulse maximum duration. A reduction of plating current density could be utilized if the process voltage tended to go above $V_2$ by means of a suitable voltage limiting constant current controlled forward power supply.

A functional block diagram of one embodiment of the present invention is shown in FIG. 3 which includes the standard plating tank containing an ambient temperature or heated electroplating solution 12. The solution 12 may be air or mechanically agitated. A solution inert anode or an anode of the metal being deposited 14 is provided in the tank to complete the current flow path to the part 16 which is to be plated. Where soluble anodes are used during operation of the apparatus, particles may flake off the anode. Therefore, a loose bag 17 of material unaffected by the electroplating solution, such as "Dynel" can be arranged around the anode to retain any particles. The anode 14 and the part to be plated 16 are connected to a power driver 18 which is supplied by positive (plating) and negative (diffusion) power supplies 20 and 22 respectively. An analog to digital converter 24 samples the voltage applied between the anode and the part to be plated and provides an input to the waveform generator and controller 26. The controller may include a visual display 28 and keyboard 30 for the display and input of control information, respectively.

According to one embodiment, an automated process would operate as follows. After power is initially turned on, the conditioning cycle runs for about five minutes. After the end of the conditioning cycle, the plating cycle would start with the analog to digital converter 24 sampling the process voltage, at the preset conditioning cycle current density, and providing a digital indication thereof to the waveform generator and controller 26. The process voltage $V_p$ is compared to $V_1$ and $V_2$ and based on the comparison, a low current, binary signal will be sent to a buffer/preamp (not shown) for initial amplification and then to the power driver. The power driver in turn provides a high voltage, high current amplification of the buffer/preamp signal thereby generating the output current waveform of FIG. 2B which is applied to the part 16. At the end of each forward pulse, the process voltage $V_p$ is sampled and the waveform generator and controller will make any alterations in the current waveform which are necessary.

In the preferred embodiment, the waveform generator and controller 26 comprises a microprocessor such as a model VIM-1 available from Synertek Systems Corp., P.O. Box 552, Santa Clara, Calif. 95052. The programmable language utilized with this microprocessor is a low level language described in the Synertek Systems VIM-1 operating manual, available from the above corporation. The following discussion relates to the software description and flowcharts which may be used for programming a microprocessor to operate in the desired manner according to the present invention.

SOFTWARE DESCRIPTION AND FLOWCHARTS

Preferably, the conditioning cycle waveform and plating cycle waveform are generated exclusively by microprocessor software and can be easily changed or modified. The parameter ranges which have been found most suitable for the conditioning cycle are as follows. The conditioning cycle duration may be five minutes with forward and reverse pulses have a duration of from one microsecond to 10 seconds, the duration of the pulses is preferably fixed during the conditioning cycle. The plating cycle has a variable cycle time which is dependent on the time necessary to reach the desired coating thickness or to reach the process voltage limit of the coating burn voltage. The latter may be a function of the plating ion concentration left in the electroprocessing solution. A typical plating cycle to achieve a coating thickness of 0.5 mil will be on the order of about 60 minutes, depending mainly on the electrolyte composition and the plating ion concentration. The plating cycle waveform will be discussed with regard to the waveform functions illustrated in FIG. 2B, but, as noted earlier, different cycle waveforms or combinations thereof can be utilized in accordance with the present invention by reprogramming the microprocessor to alter the automated process response. The duration of a positive pulse $T_{pos}$ is controlled according to the following formula:

$$T_{pos} = T_p \times (V_2 - V_p) \text{ where } T_p = \frac{(T_{pos})\max}{(V_2 - V_1)}$$

wherein $V_1$ is the minimum process voltage at which active process control begins, $V_2$ is the maximum process voltage during most operations, and $V_p$ is the instantaneous process voltage as detected during the plating process. To select $V_1$ and $V_2$, values of $V_a$ and $V_b$ must be determined. $V_a$ and $V_b$ are dependent on the plating electrolyte used, the electrolyte temperature and plating current density. $V_a$ is the initial plating voltage at which the desired current density is provided. Current density depends on the ion being deposited, for example, the current density of 10–20 amperes per square foot (ASF) is a typical range of desired current density for tin plating. Likewise, a current density of 200 to 300 ASF may be used for chromium plating. Generally, about the same current densities are used as in conventional plating. $V_b$ is the peak plating voltage at which the coating burns and may be empirically determined.

To select $V_1$ and $V_2$, coating thickness, depositing ion concentration, and plating rate must be considered because there are tradeoffs to be made. For example, FIG. 9 depicts settings for the production of thin coatings having a maximum plating rate. FIG. 10 depicts settings to produce coatings having a maximum coating uniformity and thickness at a reduction of plating rate.

After $V_1$ and $V_2$ are selected then $(T_{pos})_c$ and $(T_{neg})_c$ may be selected. $(T_{pos})_c$ is the fixed plating pulse and $(T_{neg})_c$ is a fixed negative polarity pulse during the conditioning cycle. The conditioning cycle is an optional treatment for substrates that tend to have low adhesion of subsequently applied deposits.

If the conditioning cycle is desired, the ratio of $(T_{pos})_c$ to $(T_{neg})_c$ should be about 2:1.

The ranges of $T_{pos}$ and $T_{neg}$ are determined empirically. The range of $T_{pos}$ is selected to obtain the maximum plating rate without burning. The range of $T_{neg}$ is determined to obtain maximum thickness uniformity and maximum depletion of metal ions. These ranges will depend upon the composition of the electroplating solution, the temperature of the electroplating solution, the burn voltage and the coating thickness.

The time duration of negative pulse $T_{neg}$ is controlled by the following formula:

$$T_{neg} = T_n \times (V_p - V_1) \text{ where } T_n = \frac{(T_{neg})\max}{(V_2 - V_1)}$$

Preferably, the forward pulses are applied for a time period of on the order of from about 0.5 microseconds to 300 seconds and the reverse pulses are applied for a time period of on the order of from about 0.5 microseconds to 150 seconds.

In a preferred embodiment, the forward and reverse current pulses alternate at a frequency of from about $22\times10^{-2}$ to $1.5\times10^{6}$ cycles per second during the conditioning cycle and $2.2\times10^{-3}$ to $1.5\times10^{6}$ cycles per second during the plating cycle when the process voltage is equal to or greater than $V_1$.

Figure 4:
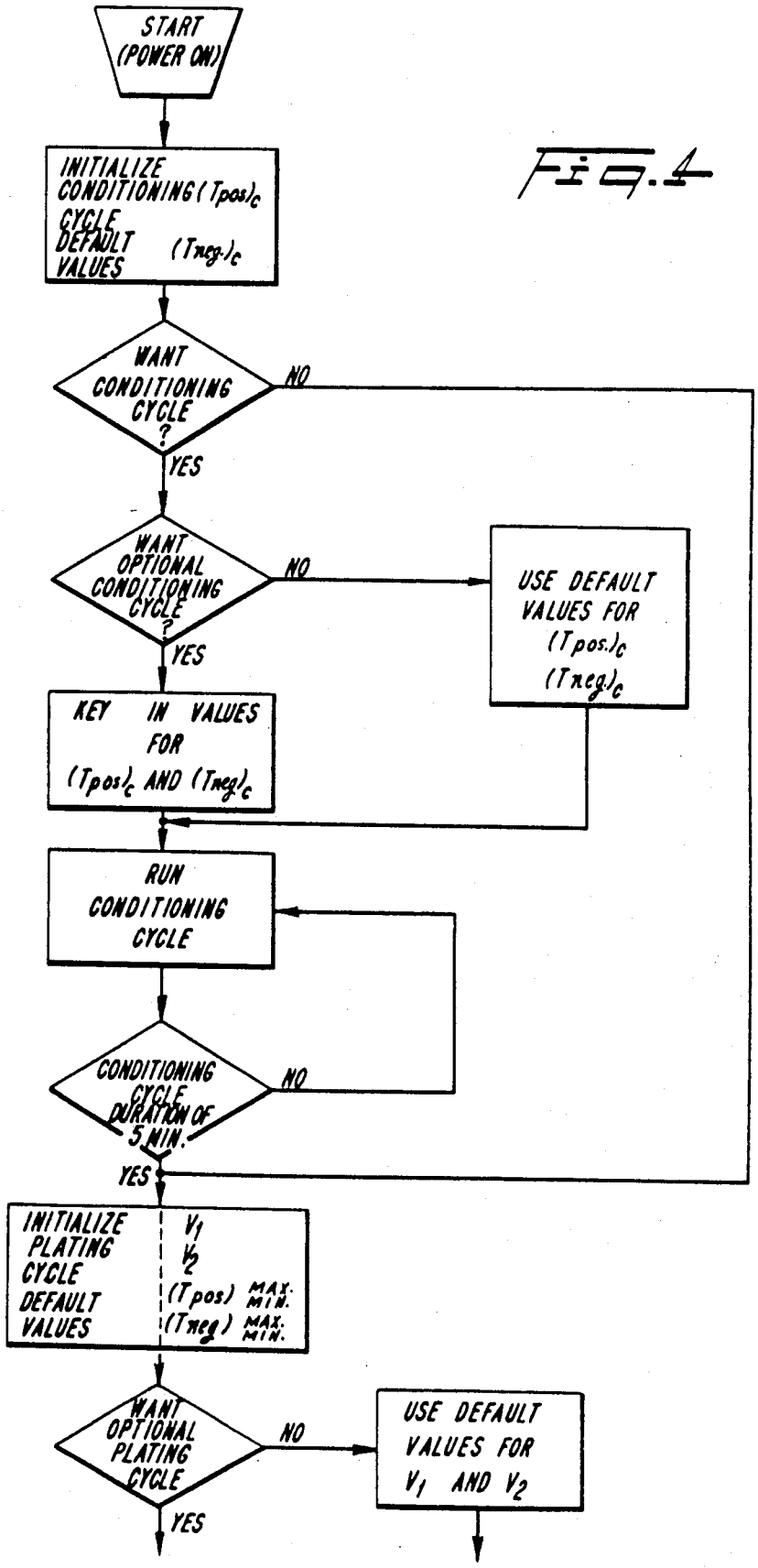
FIGS. 4–6 are flowcharts depicting the control object for the conditioning and plating cycles in accordance with one embodiment of the present invention.

As can be seen from the FIG. 4 flowchart, preset or default conditioning cycle values for $(T_{pos})_c$ and $(T_{neg})_c$ as determined above can be used or a specific conditioning pulse duration can be keyed into the microprocessor. Additionally, although the flowcharts described below are set up for a conditioning cycle of 5 minutes, this conditioning cycle duration can be changed to a longer or shorter duration depending upon the particular application.

Figure 5:
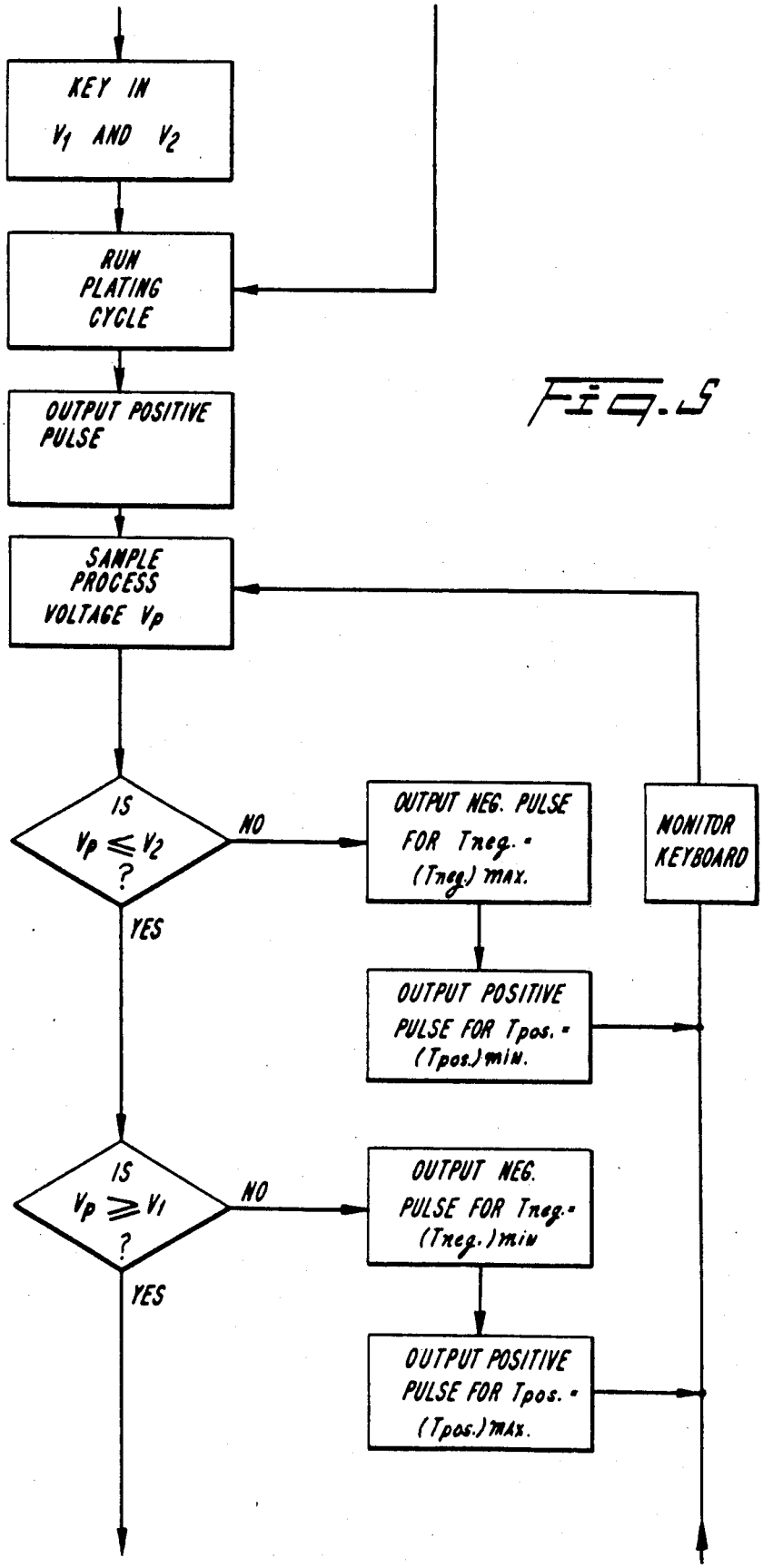
Figure 6:
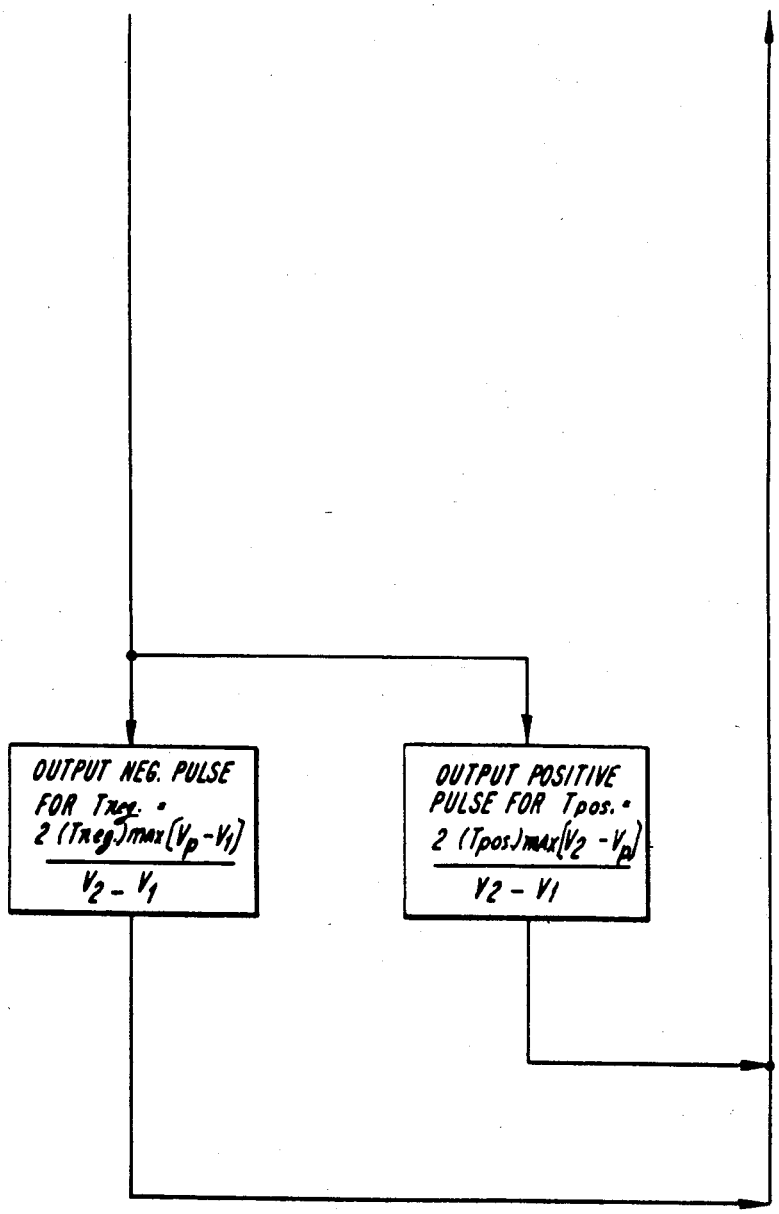

FIGS. 4–6 illustrate the microprocessor control logic of the plating cycle. As can be seen in FIG. 4, preprogrammed or default values for $V_1$, $V_2$, $(T_{pos})_{min}$, $(T_{pos})_{max}$, $(T_{neg})_{min}$, $(T_{neg})_{max}$ can be used or specific values can be keyed into the microprocessor for an optional plating cycle. The plating program flowchart figures are relatively straightforward. The end result is that the waveform is conditionally maintained with a decreasing duration for forward pulses and increasing duration for reverse pulses until maximum reverse pulse and minimum forward pulse duration is reached, as for example at the end of phase a of the plating cycle of FIG. 2B which corresponds to the process voltage being greater than $V_1$ and less than $V_2$. Finally, when the plating voltage is equal to $V_2$, the duration of the forward pulse is at a minimum and the current density amplitude of the forward pulse begins to decrease, corresponding to phase b in the plating cycle as shown in FIG. 2B if a voltage limited, constant current, controlled power supply is used. Additionally, although not shown, a total plating time loop could be included as in the conditioning cycle in order to terminate the plating process. Finally, as would be obvious to one skilled in the art of interfacing keyboards to microprocessors, a keyboard monitor program for the keyboard 30 can be utilized with the waveform generator and the controller 26.

HARDWARE INTERCONNECTION

Figure 7:
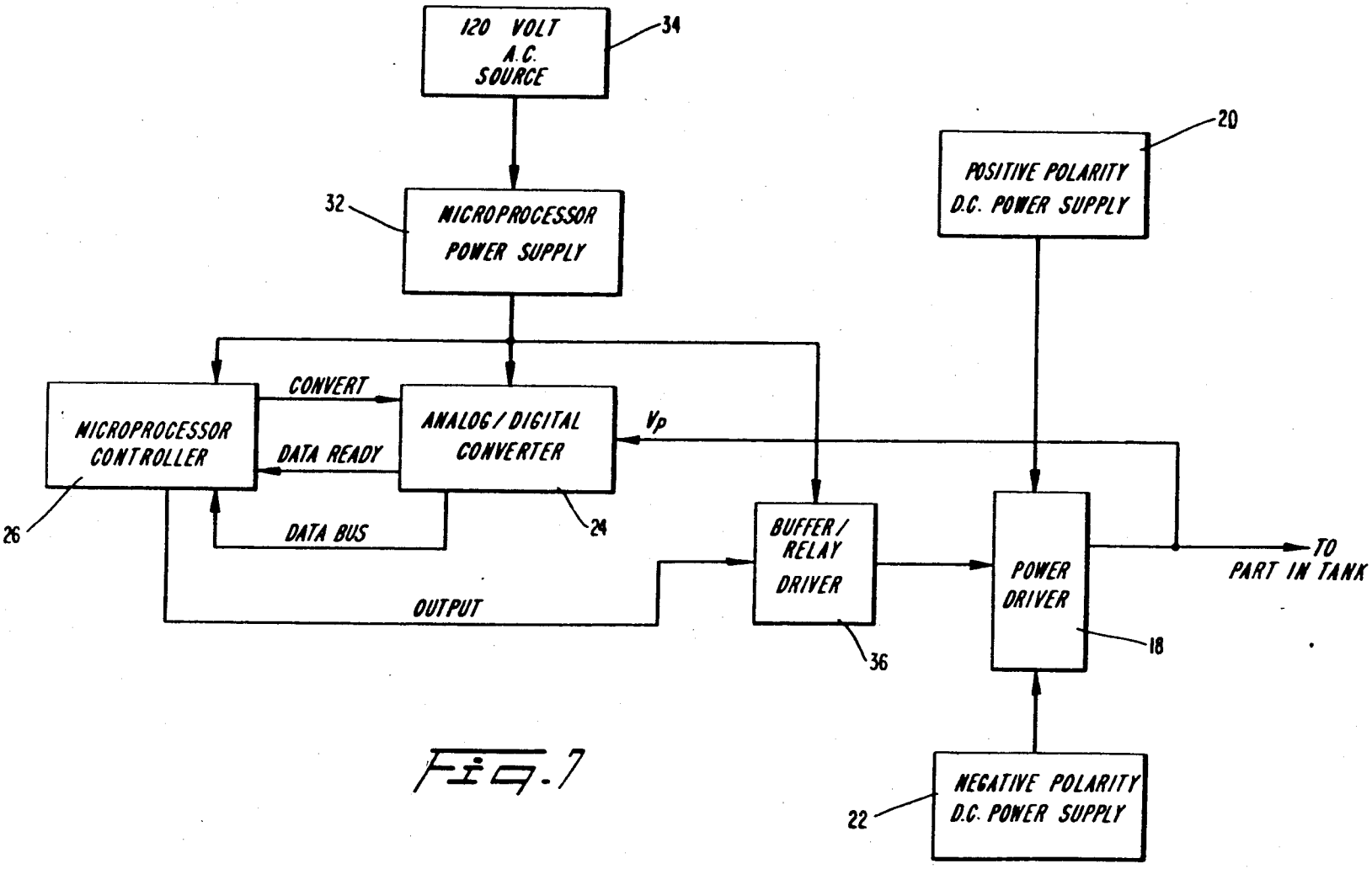
FIG. 7 is a more detailed block diagram of an apparatus in accordance with a preferred embodiment of the present invention.
Figure 8:
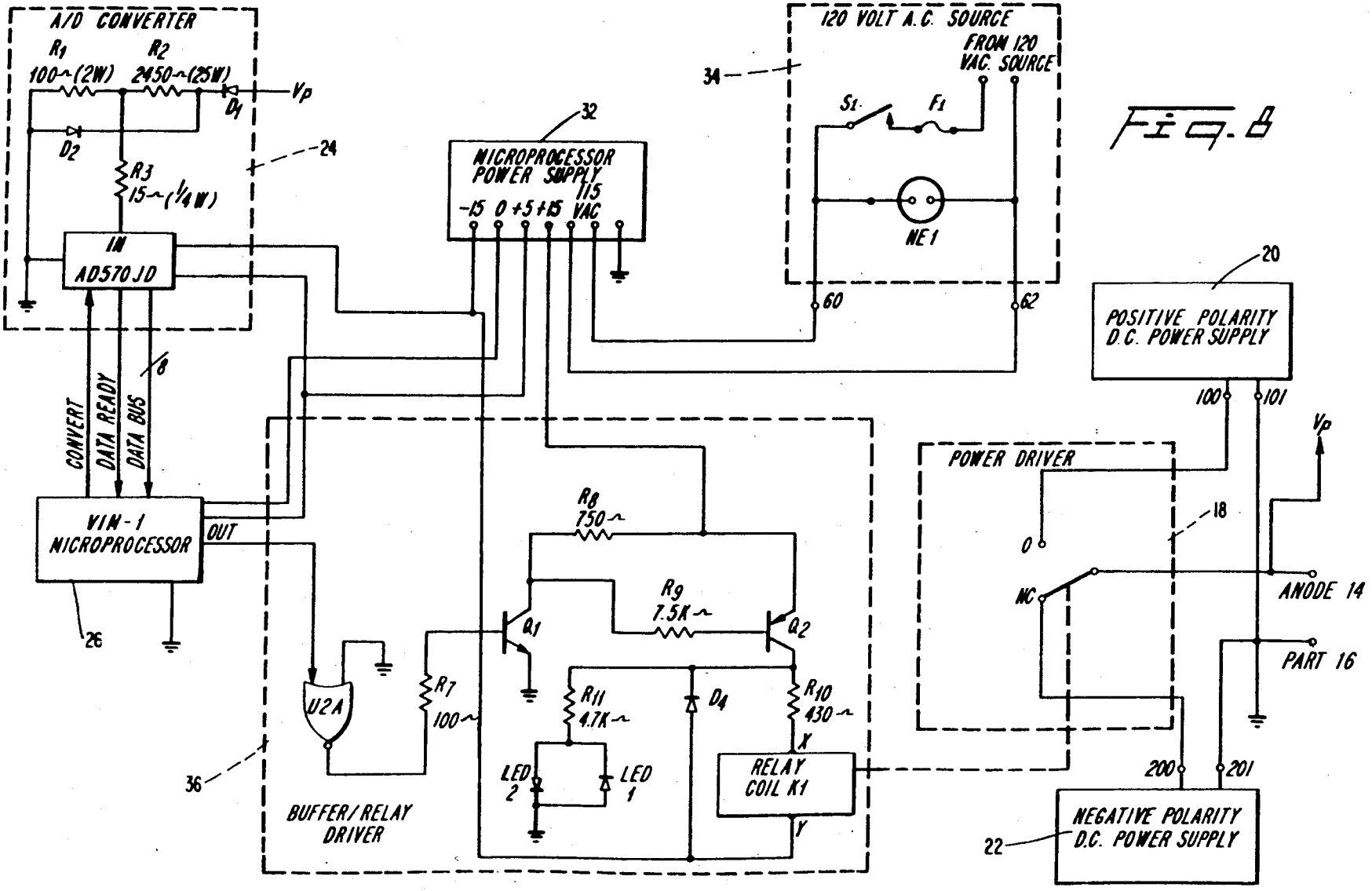
FIG. 8 is an electrical schematic of a preferred embodiment of the present invention.

FIG. 7 is a block diagram showing the process signal flow in a preferred embodiment of the present invention. FIG. 8 is a more detailed electrical circuit diagram showing the interconnections of the blocks in FIG. 7. In a preferred embodiment, the microprocessor controller 26 is the VIM-1 microprocessor as noted previously. The microprocessor is powered by a microprocessor power supply 32 which in this embodiment is a regulated power supply, Model LOT-W-5152-A manufactured by Lambda Electronics Corporation, 599 North Mathilda #210, Sunnyvale, Calif. 94086.

An unregulated 120 volt AC source provides power to the microprocessor power supply 32 which in turn supplies power not only to the microprocessor controller 26 but to the analog-to-digital converter 24 which in a preferred embodiment includes an integrated circuit, Model AD570JD, manufactured by Analog Devices, Inc., Route 1, Industrial Park, P.O. Box 280, Norwood, Mass. 02062. The A/D converter IC and its associated circuitry including R1, R2, R3, D1 and D2 comprises the analog-to-digital converter 24. The microprocessor power supply also supplies power to buffer/relay driver 36.

As can be seen in the electrical schematic of FIG. 8, the 120 volt AC source 34 is connected to an external source of AC voltage and includes an in-line fuse F1, an on-and-off power switch S1 and a neon bulb NE1 used as a power-on indicator. Terminals 60 and 62 provide a 120 volt AC output to drive the microprocessor power supply. The buffer/driver 36 includes OR-GATE-IC No. 74128 which has four gates thereon, one of which (U2A) is used. A low current-binary signal of 0 to +5 volts from the microprocessor is applied to the buffer/driver which amplifies the signal through transistors Q1 and Q2. Q2 and R10 provide current to the driver connected between terminals X and Y. This driver then controls the state of the power driver 18 which is a semiconductor switch.

The output of the OR gate U2A is fed through a base current limiting resistor R7 to the base of switching transistor Q1 which, in one embodiment, may be a 2N2219 transistor which inverts and increases the voltage level of the pulse signal. This amplified signal from Q1 then drives output transistor Q2 which, in one embodiment, may be a 2N2905A transistor with the emitter connected to the +15 volt terminal on the microprocessor power supply 32. It should be understood that power driver 18 must be a solid state switch operable above $1.5\times10^6$ Hz in order to obtain pulsing capabilities less than 1 second. Such switches are well known. The driver connected between terminals X and Y merely denotes the circuitry necessary to level shift the output of buffer/driver 36 sufficiently to drive power driver 18.

Also connected to the collector of Q2 through series resistor R11 are back-to-back light emitting diodes LED1 and LED2 which are connected to ground. Light emitting diodes LED1 and LED2 are activated depending on the polarity at terminal X to indicate the same during the duty cycle of the output signal. Terminal Y is connected to the −15 volt terminal on the microprocessor power supply 32.

Across terminals X and Y, is a diode which, in one embodiment, may be a 1N5618 diode installed in the reverse current direction to protect the circuitry from any kick-back voltage.

Power driver 18 effectively provides a high-current, high-voltage amplification to the signal input from buffer/driver 36 and provides an output signal voltage which is applied to the part being plated 16 with the anode 14 grounded. The process voltage $V_p$ is fed back to the A/D converter 24 and applied to the microprocessor in digital form on the 8-line data bus.

The power driver 18 is supplied with current-regulated positive and negative power supplies 20 and 22 as indicated in FIGS. 3, 7 and 8. The positive power supply provides a voltage up to +100 volts and 15 amps DC with the negative power supply providing a voltage up to −50 volts and 5 amps DC. The positive (+) and negative (−) terminals of power supply 20 are connected to terminals 100 and 101, respectively. The negative (−) and positive (+) terminals of power supply 22 are connected to terminals 200 and 201, respectively.

A zero volt input signal from the microprocessor 26 will turn off Q1, and Q2 will serve as an open switch. The net potential across terminals X and Y is then zero volts and the power driver 18 remains in the normally closed (NC) position and current is drawn from the negative polarity power supply 22 through power driver 18 to part 16. A +5 volt signal from the microprocessor will turn on Q1, providing a path for Q2 base current to flow. Then Q2 will serve as a closed switch and the collector of Q2 will have a +15 volt potential. The terminal Y being conected to the microprocessor power supply 32, will have a −15 volt potential. Hence, the potential from the collector of Q2 to terminal Y is 30 volts. Now the current limiting resistor R10 causes a voltage drop of about 6 volts to terminal X, such that the net potential across terminals X and Y is about +24 volts. The driver between terminals X and Y is thereby energized and power driver 18 is switched from the normally closed (NC) position to the open (O) position, thereby drawing current from the positive polarity power supply 20 and applying the current to part 16.

As noted previously, the parameters V1 and V2 can be adjusted to the optimum levels for a particular production system, the burn voltage expected, the current density desired, etc. Although a preferred embodiment of the present invention teaches the use of phases a and/or b, it can be seen that other combinations of phases a and/or b or other obvious waveforms in view thereof may be utilized. It will be obvious to one of ordinary skill in the art that if the waveform is to be varied from that specifically disclosed in FIG. 2B, the process control parameters can be suitably amended. The major criteria is that, as the metal in concentration in solution decreases, the time ratio of forward to reverse power is gradually decreased.

Although the invention has been described relative to a specific embodiment thereof, it is not so limited and many modifications and variations thereof will be readily apparent to those skilled in the art in light of the above teachings. It is, therefore, to be understood that, within the scope of the appended claims, the invention may be practiced otherwise than as specifically described.

The embodiments of an invention in which an exclusive property or privilege is claimed are defined as follows:

1. A method for electroplating the surface of an electrically conductive substrate, said method comprising the steps of:

immersing said conductive substrate surface and an electrode means in a plating solution containing metal ions;

flowing forward and reverse current pulses between said metal and said electrode means, said forward and reverse current pulses having pulse widths which define plating and diffusion time durations respectively which define a plating to diffusion time ratio, said forward pulses being of a polarity which causes said conductive substrate surface to be cathodic with respect to said electrode means and said reverse pulses being of a polarity opposite that of the forward pulses or pulses of zero magnitude wherein the flowing of said forward and reverse current pulses results in a process voltage $V_p$ between said conductive substrate surface and said electrode means;

sensing the process voltage $V_p$ during said flowing step; and varying said time ratio in response to said sensed process voltage $V_p$ to maintain $V_p$ at a level below a predetermined burn voltage, $V_b$.

2. The method of claim 1, comprising electroplating a coating on said conductive substrate surface and wherein said forward pulses comprise current pulses of a polarity which effects plating of the conductive substrate ions from the plating solution to said conductive substrate surface.

3. The method of claim 1, wherein said reverse current pulses comprise zero magnitude pulses of variable duration.

4. The method of claim 1, wherein said forward and reverse current pulses are of a generally constant magnitude and have a varying time duration.

5. The method of claim 1, wherein said varying step comprises the step of decreasing the time ratio of forward to reverse time duration.

6. The method of claim 5, wherein said decreasing step includes the step of increasing the duration of said reverse current pulses with respect to their minimum value, while maintaining the magnitude of the forward and reverse current pulses generally constant.

7. The method of claim 5, wherein said decreasing step includes the step of decreasing the duration of forward current pulses with respect to their minimum value while maintaining the magnitude of the forward and reverse current pulses generally constant.

8. The method of claim 4 further including the step of subsequently reducing the magnitude of the forward pulses while maintaining the duration of the forward and reverse pulses generally constant.

9. The method of claim 4, wherein said current flowing step comprises a conditioning step wherein forward and reverse current pulses of generally constant magnitude and duration flow between said electrode means and said conductive substrate surface.

10. The method of claim 9, wherein said current flowing step includes a plating cycle having at least two phases, both of which comprise flowing generally constant magnitude current pulses, one of said phases comprising increasing said reverse current pulse duration and the other of said phases comprising decreasing the forward current pulse duration.

11. The method of claim 10, wherein said current flowing step further includes the steps of:

sensing the process voltage between said conductive substrate surface and said electrode means during a forward current pulse; and changing phases when said process voltage reaches a predetermined voltage.

12. The method of claim 11, wherein said process voltage $V_p$ generally increases monotonically during said electroplating and said step of varying further comprises controlling a rate of increase of said process voltage during said monotonic increase.

13. An apparatus for electroplating a conductive substrate surface, said apparatus comprising:

an electroplating solution containing metal ions in which said conductive substrate surface is immersible;

circuit means, including an electrode means at least partially immersed in said solution, for flowing forward and reverse current pulses having pulse widths defining forward and reverse time durations, respectively, to said conductive substrate surface so as to produce a coating of increasing thickness on said conductive substrate surface, said forward and reverse time durations defining a time ratio, said forward pulses being of a polarity which causes said conductive substrate surface to be cathodic with respect to said electrode means and said reverse pulses being of a polarity opposite that of said forward pulses or of a zero magnitude;

means for sensing a process voltage $V_p$ between said conductive substrate surface and said electrode means resulting from said current pulses; and means responsive to said process voltage $V_p$ for varying said time ratio to maintain said process voltage $V_p$ below a predetermined burn voltage $V_b$.

14. The apparatus of claim 13, wherein said circuit means comprises:

a power driver, responsive to said means for varying the time ratio, for causing generally constant magnitude forward current pulses and generally constant magnitude reverse current pulses to flow between said electrode means and said conductive substrate surface.

15. The apparatus of claim 14, wherein said means for varying the time ratio further comprises:

process controlling means for reducing the time ratio of forward to reverse pulse durations applied to said conductive substrate surface during said electroplating.

16. The apparatus of claim 13, wherein said means for varying the time ratio is responsive to said process voltage $V_p$ during a forward current pulse to vary said time ratio.

17. The apparatus of claim 13, wherein said means for varying the time ratio is further operable to control a rate of increase of said process voltage.

18. A method for plating a conductive substrate surface using controlled current pulses flowing between said conductive surface and an electrode, said conductive surface and said electrode being disposed in a plating solution containing metal ions, said current pulses resulting in a process voltage $V_p$, between said conductive substrate surface and said electrode, said method comprising the steps of:

determining a maximum plating voltage, $V_b$, at which a coating burns;

determining an initial plating voltage, $V_a$, at which an initial conditioning current is provided;

selecting a first voltage, $V_2$, equal to or less than $V_b$ and a second voltage, $V_1$, less than, equal to or greater than $V_a$ but less than $V_2$;

sensing said process voltage $V_p$ during the flowing of said current pulses; and controlling a time ratio of said current pulses in response to said sensed process voltage $V_p$ to maintain said process voltage, $V_p$, which generally increases over time, between $V_1$ and $V_2$, to effect a generally high plating rate, said current pulses comprising forward and reverse pulses having pulse widths which define forward and reverse time durations, respectively, said forward to reverse time durations defining said time ratio wherein the instantaneous value of $V_p$ is a function of said time ratio, said forward pulses being of a polarity which causes said conductive substrate surface to be cathodic with respect to said electrode, and said reverse pulses being of a polarity opposite said forward pulses or of a zero magnitude.

19. A method according to claim 18, wherein said forward pulses produce a current density of plating polarity at said metal surface of on the order of about 10 to 300 amperes per square foot and wherein said reverse pulses produce a current density at said surface of on the order of about 0.0 to 100 amperes per square foot.

20. The method according to claim 19, wherein the step of controlling further comprises:

applying said forward pulses for a time period of on the order of about 0.5 microseconds to 300 seconds; and applying said reverse pulses for a time period of on the order of about 0.5 microseconds to 150 seconds.

21. The method of claim 18, wherein said forward and reverse current pulses alternate at a frequency of from about $2.2\times10^{-3}$ to $1.5\times10^{6}$ cycles per second.

22. The method of claim 21, wherein said step of controlling further comprises applying said current pulses in at least two separate cycles, a first of said cycles being a conditioning cycle characterized by a process voltage greater than or equal to $V_a$ and relatively short, generally constant duration forward and reverse current pulses operable to condition said conductive substrate surface to improve the plating deposit adhesion to it.

23. The method of claim 22, wherein said condition cycle is performed for on the order of 5 minutes.

24. The method of claim 23, wherein during said conditioning cycle, said forward and reverse pulses alternate at a frequency of on the order of about $2.2\times10^{-2}$ to $1.5\times10^{6}$ cycles per second.

25. The method of claim 22, wherein a second of said cycles is a plating cycle wherein said process voltage is greater than or equal to $V_1$ and said forward and reverse pulses alternate at a frequency in the range of from about $2.2\times10^{-3}$ to $1.5\times10^{6}$ cycles per second.

26. The method of claim 18 including the step of varying the values of $V_1$ and $V_2$ in order to individually tailor the plating process behavior and electrolyte solution properties.

27. The method of claim 18, wherein said step of controlling further comprises controlling a rate of increase of said process voltage.

* * * * *